United States Patent [19]

Dornier

[11] Patent Number: 4,919,171

[45] Date of Patent: Apr. 24, 1990

[54] AIR JET WEAVING LOOM WITH AN EXPANDER HAVING AN EXTENSION

[75] Inventor: Peter Dornier, Lindau, Fed. Rep. of Germany

[73] Assignee: Lindauer Dornier Gesellschaft mbH, Lindau, Fed. Rep. of Germany

[21] Appl. No.: 335,043

[22] Filed: Apr. 7, 1989

[30] Foreign Application Priority Data

Apr. 7, 1988 [DE] Fed. Rep. of Germany ..... 3811653

[51] Int. Cl.[5] ..... D03D 47/30; D03J 1/22

[52] U.S. Cl. ..... 139/435.1; 139/292

[58] Field of Search ..... 139/291, 292, 294, 295, 139/188 R, 192, 435

[56] References Cited

U.S. PATENT DOCUMENTS 3,580,292 5/1971 Rambousek ..... 139/291 R
3,621,886 11/1971 Van Mullekom ..... 139/292
4,116,243 9/1978 Vettiger ..... 139/192

*Primary Examiner*—Henry S. Jaudon
*Attorney, Agent, or Firm*—W. G. Fasse; D. H. Kane, Jr.

[57] ABSTRACT

An air jet weaving loom equipped with a rod-type expander, has a weaving reed forming a weft thread insertion channel. The expander has an extension reaching toward the channel and preferably to about the center of the channel. The extension has a top surface which forms an elongation of a fabric supporting surface of the expander. This arrangement assures that the beat-up or interlacing point is always located about centrally in the weft thread insertion channel.

4 Claims, 1 Drawing Sheet

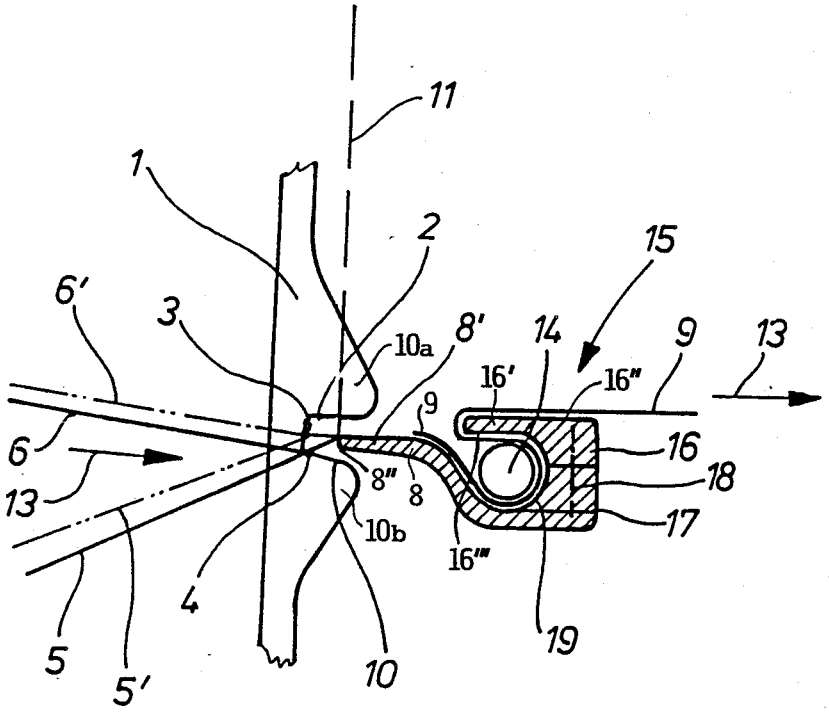
11
1
2
15
6'
3
10a
8'
14
9
13
16'
16"
9
6
16
13
8"
8
18
10b
17
16'''
4
19
5
5'
10

AIR JET WEAVING LOOM WITH AN EXPANDER HAVING AN EXTENSION

CROSS-REFERENCE TO RELATED APPLICATION

The present application relates to copending application U.S. Ser. No.: 07/335,032, filed on the same date, namely Apr. 7, 1989, with the present application, and also entitled: "AIR JET WEAVING LOOM WITH AN EXPANDER HAVING AN EXTENSION".

FIELD OF THE INVENTION

The present invention relates to an air jet weaving loom wherein a plurality of reed teeth form a weft thread insertion channel. Such a loom is equipped with an expander.

BACKGROUND INFORMATION

It is known to arrange an expander table in front of the weaving reed for properly spreading the woven fabric. Conventionally, the expander table does not reach into the weft thread insertion channel. Such a structure has several disadvantages. First, the location of the interlacing or "beat-up" point varies with fabrics of different interlacing or binding numbers, for example, a ¼ type binding or a 4/1 type binding. Conventionally, the interlacing or beat-up point could travel within the weft thread insertion channel, for example upwardly or downwardly, thereby colliding with an edge of the reed teeth. Such collisions have a tendency to damage the weft thread. Second, another disadvantage is seen in that the beat-up line or interlacing line where the woven fabric begins, contacts the weft thread inserting nozzles spaced along the weft thread insertion channel, whereby again damage can be caused, but this time to the fabric itself. Third, it has not been possible heretofore with these air jet looms to weave tightly or densely woven fabrics because it has not been possible to tightly beat-up the weft thread along the interlacing or beat-up line formed by all interlacing points along the weft thread insertion channel.

OBJECTS OF THE INVENTION

In view of the foregoing it is the aim of the invention to achieve the following objects singly or in combination:

to improve an air jet weaving loom having a weaving reed and a spreader table in such a manner that the interlacing line or beat-up line is always located relatively centrally in the middle or center of the weft thread insertion channel independently of the type of fabric being produced;

to avoid the uncontrolled movement of the beat-up or interlacing line that has been encountered heretofore; and to guide the edge of the fabric along the beat-up line away from the reed teeth to avoid damage to the fabric and to the individual weft threads.

SUMMARY OF THE INVENTION

According to the invention there is provided a spreader table for the fabric which spreader table is constructed as a rod-type spreader which is equipped with an extension projecting toward the weft thread insertion channel, said extension having a top surface forming an elongation of a fabric supporting surface of the rod-type expander for positively locating a beat-up or interlacing position of each weft thread, preferably along a center line in the weft thread insertion channel.

The combination of a rod-type spreader with an extension projecting with its free edge preferably into the center of the weft thread insertion channel has several advantages. First, damage to the weft thread and to the fabric as it is being formed along the beat-up line is avoided. Second, a tight beat-up of the fabric is now possible so that fabrics of higher weight can be produced, such as ticking, percale, sail cloth, and the like. Third, by centerin the beat-up or interlacing line of the fabric in the center of the weft thread insertion channel, any excursions of the weft thread up or down or sideways within the insertion channel are avoided, regardless of the type of binding or weave texture.

By locating the free edge of the rod-type spreader approximately in the center of the weft thread insertion channel, the interlacing or beat-up line is positively defined and is maintained within the weft thread insertion channel so that the reed teeth edges cannot damage the fabric nor the weft thread anymore. More specifically, the finished fabric, or rather its edge along the beat-up line, can now be guided away from the weft thread insertion nozzles by means of the rod-type spreader projection. As a result, it is further possible to adjust any desired loom shed geometry so that the upper loom shed section and the lower loom shed section can be located lower, enabling a weaving in the so-called sack. This feature has the advantage that the weft thread insertion nozzles cannot mar the fabric and that the fabric in turn cannot run against the lower projection of the reed teeth. Thus, damages to the fabric and tearing of weft threads is avoided.

BRIEF DESCRIPTION OF THE DRAWING

In order that the invention may be clearly understood, it will now be described, by way of example, with reference to the single figure of the accompanying drawing, showing a side view into the loom shed in the direction of the weft thread insertion and illustrating the rod-type spreader in a sectional view.

DETAILED DESCRIPTION OF A PREFERRED EXAMPLE EMBODIMENT AND OF THE BEST MODE OF THE INVENTION

The Figure shows only one reed tooth 1. Conventionally, a plurality of such teeth 1 form the weaving reed. Each reed tooth 1 has an upper projection 10*a* and a lower projection 10*b* to form a weft thread insertion channel 2. Air jets not shown insert and transport the weft thread through the insertion channel 2 perpendicularly to the plane of the drawing sheet. The finished fabric 9 is withdrawn in the direction of the arrow 13.

Dash-dotted lines 5' and 6' indicate the warp threads in an ideal position because the bent-up point or interlacing point 3 is located at the bottom center of the insertion channel 2. Such location of the binding point or interlacing point is desirable because it results in a high quality dense fabric 9. On the other hand, the full lines 5 and 6 represent warp threads which merge in a beat-up point 4 on the upwardly facing edge 10 of the lower projection 10*b*. This is undesirable because it leads to a marred fabric and also to ruptured or damaged weft threads. In order to avoid the problem of displaced beat-up or interlacing points, the invention uses a modified rod-type expander 15 which has an top section 16 and a lower section 17 connected to each other, for example, by threaded bolts only symbolically shown by a dashed line 18. The top section 16 and the lower section 17 together form an approximately circular fabric guide path or channel 19 in which a fabric guide and spreader rod 14 clamps the fabric 9 after each beat-up, whereby the fabric 9 is looped around the rod 14 with a looping angle larger than 180° as shown in the Figure to keep the fabric spread and avoid warping as the fabric is rolled up onto a take-up roller not shown. The rod 14 extends longitudinally in the channel 19. The top section 16 of the rod-type expander 15 has an extension 16' which has a fabric guide surface 16 facing substantially downwardly and forming part of the looping fabric guide path or channel 19. The extension 16' also has an upwardly facing surface 16 for supporting the fabric 9.

According to the invention the expander bottom section has an extension 8 forming a straight edge 8'' with a flat top surface 8'. The extension 8 with its straight edge 8 projects toward and into the weft thread insertion channel 2 during beat-up by the reed. The extension 8 is so curved upwardly that its flat top surface 8' is located in a substantially horizontal level defined by the downwardly facing surface of the extension 16', whereby the looping angle of the fabric 9 around the spreader rod 14 in the fabric guide path or channel 19 becomes as large as possible for an effective spreading of the fabric. Further, the top surface 8' forms an elongation of the upwardly facing surface of the extension 16' of the rod-type expander 15, whereby a further improvement of the fabric guiding is achieved because the fabric supporting guide surface is enlarged.

Preferably, the extension 8 has a free edge 8'' which extends all the way to the center of the insertion channel 2. This feature makes sure that the beat-up point or interlacing point is maintained at the desired position so that the weft thread is moved in a controlled manner during beat-up. The center of the insertion channel 2 is located approximately at an intersection of the middle of a vertical height line 11 through the middle of a horizontal depth line of the weft thread insertion channel. The depth of the insertion channel 2 is measured horizontally from the tip of the longest projection 10*a* to the bottom of the channel 2.

With the aid of the extension 8 located with its free or straight edge 8'' as just described, the invention makes sure that the beat-up point is always centered approximately in the center of the channel 2 so that the binding or beat-up of the weft thread always occurs centrally in the channel 2, whereby an undesirable interlacing or beat-up point such as at point 4 is avoided. As a result, the fabric is not contacted by the weft insertion air nozzles and the weft thread cannot be damaged or cut by the edge 10.

It has been found that an air jet loom modified as taught herein is especially suitable for weaving fine and dense fabrics, such as ticking, percale, sail cloth, and the like.

Although the invention has been described with reference to specific example embodiments, it will be appreciated that it is intended to cover all modifications and equivalents within the scope of the appended claims.

What I claim is:

1. An air jet weaving loom, comprising a weaving reed including reed teeth forming a weft thread insertion channel for beating-up each inserted weft thread at a beat-up point, a rod-type expander arranged alongside said weaving reed to face said weft thread insertion channel, said rod-type expander having a top section (16) forming fabric supporting surfaces (16'') and (16'''), and a bottom section (17) enclosing with said top section an expander channel (19) through which finished fabric is passed in a spread manner, a fabric guide rod (14) extending longitudinally in said expander channel (19) for guiding said fabric through said expander channel before said fabric can loop around said top section (16), said expander bottom section (17) having an extension (8) with a straight edge (8'') and a flat top surface (8') forming an elongation of said fabric supporting surface (16''') of said top section, said straight edge (8'') being positioned in the proximity of said beat-up point for projecting into said weft thread insertion channel during beat-up so as to positively located said beat-up point.

2. The air jet weaving loom of claim 1, wherein said supporting surface (16''') is downwardly facing and approximately horizontal, said flat top surface (8') of said extension (8) of said expander bottom section (17) being located substantially level with said supporting surface (16''') for an improved looping angle of said fabric around said guide rod (14) in said expander channel (19).

3. The air jet weaving loom of claim 1, wherein said straight edge of said expander bottom section extends with its forward end substantially to the center of said weft thread insertion channel.

4. The air jet weaving loom of claim 1, wherein said bottom section has an upwardly curved portion smoothLy merging into said extension (8) with its flat top surface (8').

* * * * *